US007644718B2

(12) United States Patent
Jeong et al.

(10) Patent No.: US 7,644,718 B2
(45) Date of Patent: Jan. 12, 2010

(54) SUMP OF DISH WASHER

(75) Inventors: Hae Deog Jeong, Changwon-si (KR); Byung Hwan Ahn, Gimhae-si (KR); Hung Myong Cho, Gimhae-si (KR); Sang Woo Woo, Changwon-si (KR); Jong Chul Bang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 608 days.

(21) Appl. No.: 11/295,675

(22) Filed: Dec. 7, 2005

(65) Prior Publication Data

US 2006/0118146 A1 Jun. 8, 2006

(30) Foreign Application Priority Data

Dec. 7, 2004 (KR) ..... 10-2004-0102564

(51) Int. Cl.
*B08B 3/04* (2006.01)
*A47L 15/00* (2006.01)

(52) U.S. Cl. ..... 134/104.1; 134/104.4; 134/111

(58) Field of Classification Search ..... 134/25.2, 134/56 D, 57 D, 58 D, 104.1, 104.4, 110, 134/111

See application file for complete search history.

(56) References Cited

U.S. PATENT DOCUMENTS 4,060,346 A * 11/1977 Meyers ..... 417/360
4,085,761 A * 4/1978 Grunewald ..... 134/104.1
4,150,680 A * 4/1979 Johnson et al. ..... 134/104.4
4,168,715 A * 9/1979 Spiegel et al. ..... 134/104.4
4,243,431 A * 1/1981 Dingler et al. ..... 134/104.1
4,347,861 A * 9/1982 Clearman et al. ..... 134/104.4
4,392,891 A * 7/1983 Meyers ..... 134/10
4,559,959 A * 12/1985 Meyers ..... 134/56 D
4,673,441 A * 6/1987 Mayers ..... 134/18
5,333,631 A * 8/1994 Kirkland et al. ..... 134/104.1
5,450,868 A * 9/1995 Young, Jr. ..... 134/111
5,623,956 A * 4/1997 Kirkland ..... 134/104.3
5,779,812 A * 7/1998 Thies et al. ..... 134/10
5,803,100 A * 9/1998 Thies ..... 134/104.4
5,848,601 A * 12/1998 Thies ..... 134/104.4
5,909,743 A * 6/1999 Thies et al. ..... 134/10
6,103,017 A * 8/2000 Thies et al. ..... 134/10
6,182,674 B1 * 2/2001 Jozwiak et al. ..... 134/56 R
6,418,943 B1 * 7/2002 Miller ..... 134/104.1
6,698,438 B2 * 3/2004 Hegeman et al. ..... 134/110
6,811,617 B2 * 11/2004 Elick et al. ..... 134/10
6,832,617 B2 * 12/2004 Hegeman et al. ..... 134/111
7,146,992 B2 * 12/2006 Elick et al. ..... 134/94.1
7,252,101 B2 * 8/2007 Elick et al. ..... 134/111
7,255,113 B2 * 8/2007 Elick et al. ..... 134/56 D
7,404,864 B2 * 7/2008 Welch ..... 134/10
7,409,962 B2 * 8/2008 Welch ..... 134/198

(Continued)

*Primary Examiner*—Joseph L Perrin
(74) *Attorney, Agent, or Firm*—McKenna Long & Aldridge LLP

(57) ABSTRACT

There is provided a sump assembly of a dishwasher. The sump assembly includes a self-cleaning filter assembly having a mesh filter, a sump cover for mounting the self-cleaning filter assembly on a top surface thereof, the sump cover having a filter supporting sleeve extending upward for supporting the self-cleaning filter assembly, a sump case seating on an upper portion of the sump cover to reserve washing water, and a fluid passage guide for discharging the washing water stored in the sump case in a predetermined direction, the fluid passage guide having a washing pump disposed therein.

19 Claims, 7 Drawing Sheets

U.S. PATENT DOCUMENTS

| | | | | |
|---|---|---|---|---|
| 7,467,636 | B2 * | 12/2008 | Welch | 134/111 |
| 7,472,711 | B2 * | 1/2009 | Johnson et al. | 134/94.1 |
| 2004/0159337 | A1 * | 8/2004 | Johnson et al. | 134/18 |
| 2004/0163690 | A1 * | 8/2004 | Kim | 134/104.1 |
| 2005/0263174 | A1 * | 12/2005 | Yoon et al. | 134/104.1 |
| 2006/0042657 | A1 * | 3/2006 | Welch | 134/10 |
| 2006/0042668 | A1 * | 3/2006 | Welch | 134/111 |
| 2006/0054200 | A1 * | 3/2006 | Min et al. | 134/56 D |
| 2006/0118146 | A1 * | 6/2006 | Deog Jeong et al. | 134/56 D |
| 2006/0174916 | A1 * | 8/2006 | Hedstrom et al. | 134/25.2 |
| 2007/0261725 | A1 * | 11/2007 | Choi et al. | 134/104.2 |
| 2008/0163903 | A1 * | 7/2008 | Bang | 134/184 |

* cited by examiner

SUMP OF DISH WASHER

This application claims priority to Korean Application 10-2004-0102564 filed on Dec. 7, 2004, which is incorporated by reference, as if fully set forth herein.

BACKGROUND OF THE INVENTION

1. Field of the Invention

The present invention relates to a dishwasher, and more particularly, to a sump assembly of a dishwasher, which can effectively remove foreign objects clogging an inner surface of a self-cleaning assembly mounted on an upper portion of the sump assembly.

2. Description of the Related Art

Generally, a dishwasher is a machine that washes and dries dishes loaded on upper and lower racks by spraying washing water pumped by the washing pump toward the upper and lower racks through spraying nozzles. The dishwasher includes a tub defining an outer appearance of the dishwasher, at least one rack disposed in the tub to load dishes, at least one spraying nozzle for spraying washing water to surfaces of the dishes, and a sump assembly mounted on a floor of the tub to reserve the washing water. Foreign objects such as food wastes adhered to the dishes are removed from the dishes by pressure applied by washing water sprayed from a spraying nozzle. The food wastes removed from the dishes are reserved on a floor of the tub.

Meanwhile, the self-cleaning filter assembly mounted on the sump assembly has a surface level identical to a floor surface of the tub. Therefore, when the washing water is reserved on the floor of the tub, the self-cleaning filter is to be immersed in the washing water reserved on the floor of the tub. When the mesh filter 128 is immersed in the washing water, the washing water sprayed from the lower nozzle cannot reach the mesh filter 128. That is, since the washing water cannot be sprayed from the lower nozzle up to the self-cleaning filter assembly by the washing water reserved on the floor of the tub, the spraying pressure of the washing water cannot applied to the self-cleaning filter assembly. In this case, since the self-cleaning filter assembly cannot be cleaned, the purifying capability of the self-cleaning filter assembly may be deteriorated.

SUMMARY OF THE INVENTION

Accordingly, the present invention is directed to a sump assembly of a dishwasher that substantially obviates one or more problems due to limitations and disadvantages of the related art.

An object of the present invention is to provide a sump assembly of a dishwasher, which can improve a purifying capability of a self-cleaning filter assembly mounted on an upper portion of the sump assembly.

Another object of the present invention is to provide a sump assembly of a dishwasher, which can improve a filtering efficiency of a self-cleaning filter assembly by improving a purifying capability of the self-cleaning filter assembly through a simple improvement of a structure thereof.

Still another object of the present invention is to provide a sump assembly of a dishwasher, which can prevent fouling of a filter by effectively applying spraying pressure of washing water spraying from a lower nozzle and maintaining a suspension state of foreign objects.

To achieve these objects and other advantages and in accordance with the purpose of the invention, as embodied and broadly described herein, there is provided a sump assembly of a dishwasher, including: a self-cleaning filter assembly having a mesh filter; a sump cover for mounting the self-cleaning filter assembly on a top surface thereof, the sump cover having a filter supporting sleeve extending upward for supporting the self-cleaning filter assembly; a sump case seating on an upper portion of the sump cover to reserve washing water; and a fluid passage guide for discharging the washing water stored in the sump case in a predetermined direction, the fluid passage guide having a washing pump disposed therein.

In another aspect of the present invention, there is provided a sump assembly of a dishwasher, including: a sump case for reserving washing water; a fluid passage guide having a washing pump therein to discharge washing water in a plurality of directions; a sump cover provided an upper portion of the fluid passage guide and exposed to an inside of the tub to receive the washing water; a filter supporting sleeve protruded above the sump cover; a self-cleaning filter seating on the filter supporting sleeve and located at a predetermined level higher than a predetermined height; and a mesh filter provided on at least opening of the self-cleaning filter to filter foreign objects entrained in the washing water flowing backward from the sump cover toward the tub.

In still another aspect of the present invention, there is provided a sump assembly of a dishwasher, including: a sump case for reserving washing water; a fluid passage guide having a washing pump therein to discharge washing water in a plurality of directions; a sump cover provided an upper portion of the fluid passage guide and exposed to an inside of the tub to receive the washing water; a lower nozzle for spraying downward the washing water directed through the fluid passage guide; a filter supporting sleeve integrally formed with the sump cover and protruded above the sump cover; a self-cleaning filter seating on the filter supporting sleeve and located at a predetermined level higher than a predetermined height; and a mesh filter provided on at least opening of the self-cleaning filter to filter foreign objects entrained in the washing water flowing backward from the sump cover toward the tub.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art.

Figure 1:
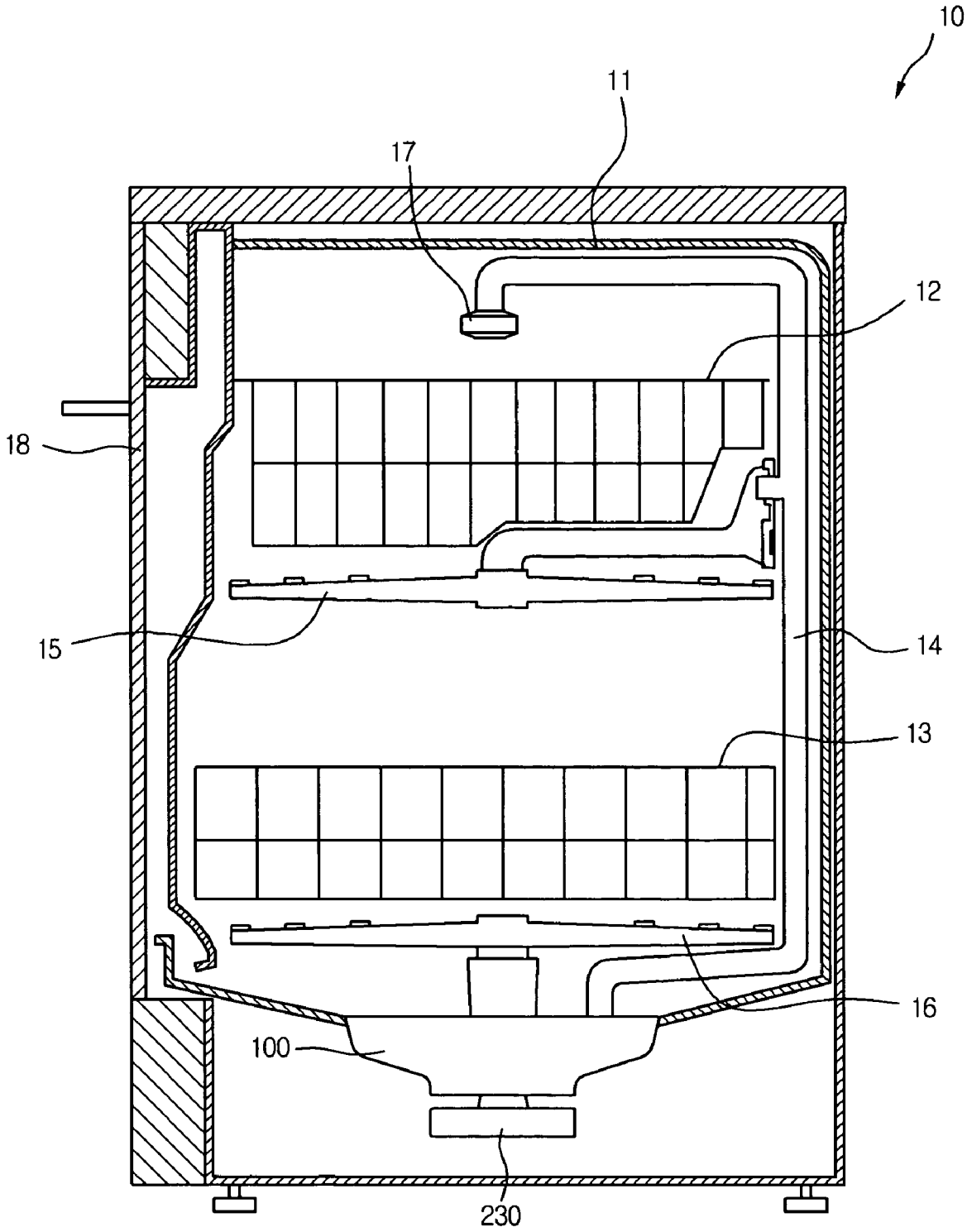
FIG. 1 is a sectional view of a dishwasher having a sump mounting structure according to an embodiment of the present invention.

FIG. 1 is a sectional view of a dishwasher according to an embodiment of the present invention.

Referring to FIG. 1, a dishwasher 10 according to the present invention includes a tub 11 forming the outer shape of the dishwasher 10 and a wash chamber within, a door 18 formed at the front of the tub 11 for opening and closing the wash chamber, and a sump assembly 100 formed at a central bottom portion of the tub 11 for storing washing water.

Additionally, the dishwasher 10 includes a wash motor 230 attached to the bottom end thereof for driving a wash pump (not shown) disposed inside the sump assembly 100, a fluid passage guide 14 providing a passage for washing water pumped by the wash pump, a lower nozzle 16 coupled to the top of the sump assembly 100 for spraying washing water within the wash chamber in an upward and/or downward direction, an upper nozzle 15 attached at an upper portion of the fluid passage guide 14 to extend horizontally therefrom to be centrally disposed inside the wash chamber, and a top nozzle 17 formed at the ceiling of the tub 101 to spray washing water in a downward direction.

Additionally, the dishwasher 10 includes an upper rack 12 installed above the upper nozzle 15 to wash dishes with the upper nozzle 15, and a lower rack 13 installed above the lower nozzle 16 to wash dishes with the lower nozzle 16.

The operation of the above dishwasher 10 according to the present invention will now be described.

First, a user opens the door 18 of the dishwasher 10, pulls the upper and/or lower racks 12 and 13 out, and places dishes in the upper rack 12 and/or the lower rack 13. The door 18 is then closed, power is turned on, and the dishwasher 10 is activated.

When power to the dishwasher 10 is turned on and a wash cycle is instigated, washing water enters the sump assembly 100 from a water supply. After a predetermined amount of washing water enters the sump assembly 100, the wash motor 230 operates. An impeller (150 in FIG. 2), connected to a shaft of the wash motor 230 and disposed inside the wash pump, rotates to pump washing water to the lower nozzle 16 and the fluid passage guide 14.

The washing water pumped to the fluid passage guide 14 ultimately flows to the top nozzle 17 and the upper nozzle 15 to be sprayed therefrom into the wash chamber. The sprayed wash water washes dishes placed in the racks 12 and 13.

Here, the top nozzle 17 sprays washing water in a vertically downward direction and the upper nozzle 15 sprays washing water in a vertically upward direction to wash dishes placed in the upper rack 12.

The lower nozzle 16 sprays washing water in a vertically upward direction to wash dishes placed in the lower rack 13. Additionally, the upper nozzle 15 may have spray holes also formed at the bottom thereof to spray washing water in both upward and downward directions, to wash the tops of dishes placed in the lower rack 13 at the same time.

When the wash cycle is completed, the dirty washing water collected in the sump assembly 100 is removed of foreign object by means of a filter (not shown). A washing water drain pump (not shown) dispels the filtered washing water to the outside of the dishwasher 10.

After the washing water is dispelled to the outside, fresh washing water enters the sump assembly 100 through an inlet, whereupon the washing water is sprayed through the nozzles 15 and 16 in the same manner as in the wash cycle. The clean, sprayed washing water rinses the dishes in a rinse cycle. When the rinse cycle is completed, a drying cycle is implemented to complete the dishwashing process.

Figure 2:
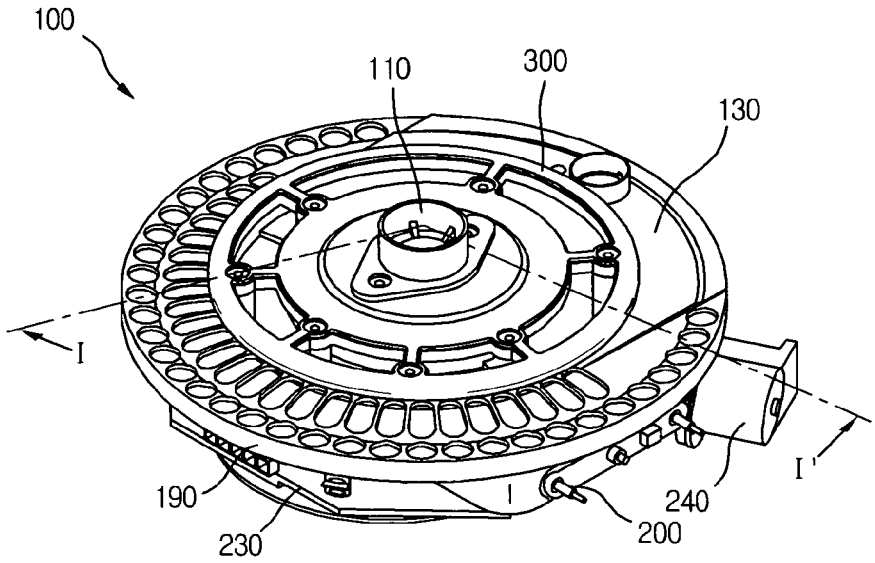
FIG. 2 is a perspective view of a sump assembly depicted in FIG. 1.
Figure 3:
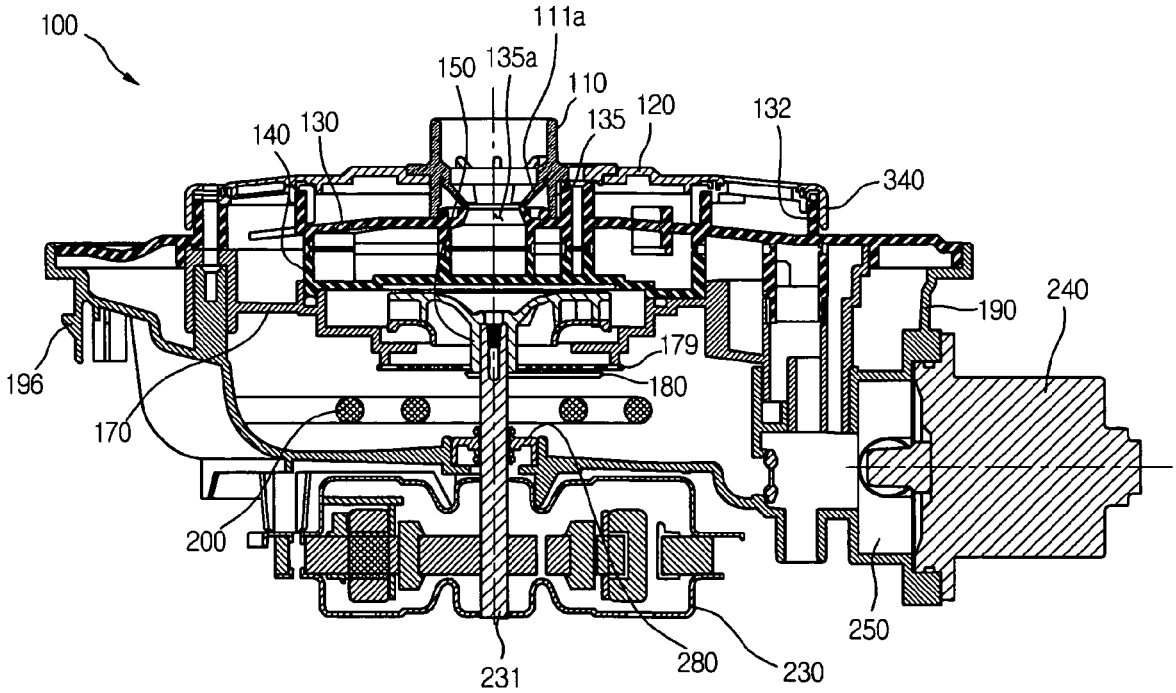
FIG. 3 is a vertical sectional view taken along lines I-I' of FIG. 2.
Figure 4:
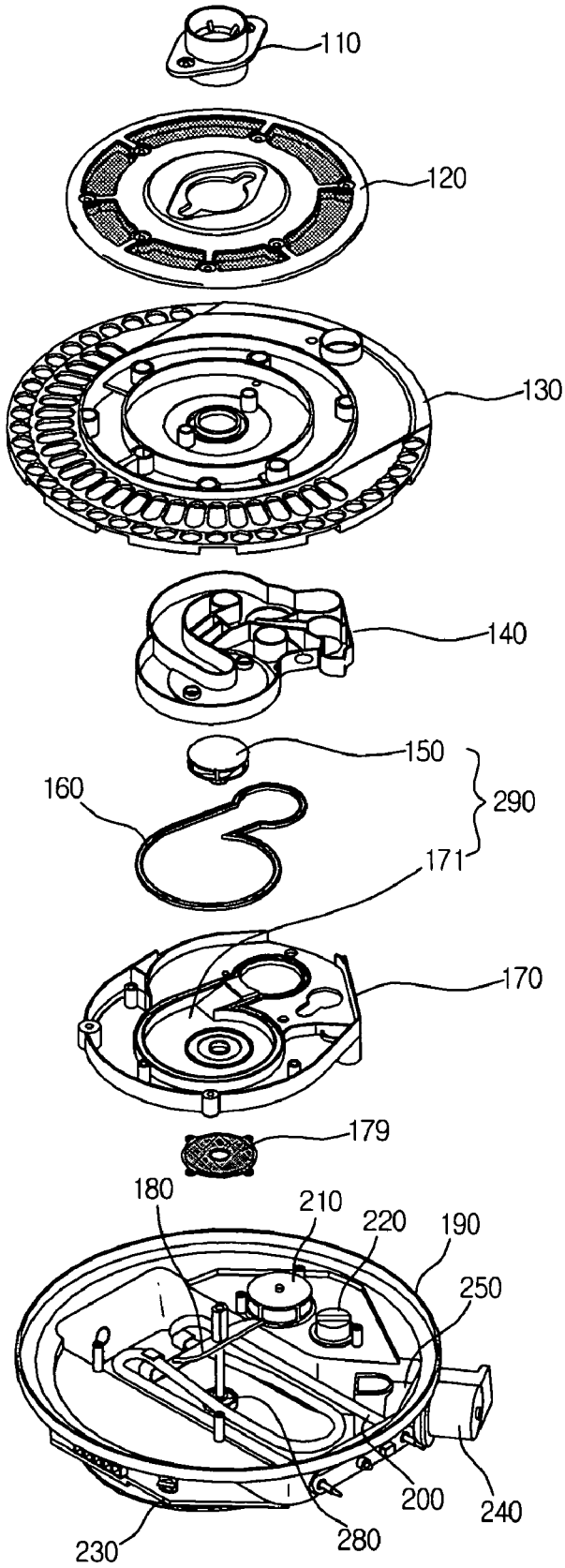
FIG. 4 is an exploded perspective view of a sump case depicted in FIG. 2.

FIG. 2 is a perspective view of a sump according to the present invention, FIG. 3 is a sectional view of the sump in FIG. 2 taken along line I-I, and FIG. 4 is an exploded view of a sump according to the present invention.

Referring to FIGS. 2 through 4, the sump assembly 100 according to the present invention includes: a sump case 190 disposed at a lowermost end thereof for storing washing water, a sump cover 130 that covers the upper surface of the sump case 190, a self-cleaning filter assembly 300 stepped a predetermined height from and mounted on the top surface of the sump cover 130, a lower nozzle holder 110 mounted on the central portion of the self-cleaning filter assembly 300 and connected to the lower nozzle 16, a wash motor 230 installed at the bottom of the sump case 190 for imparting rotational force, and a drain pump 250 and a drain motor 240 installed on a side of the sump case 190 for draining washing water to the outside.

The sump assembly 100 further includes: a heater 200 installed at the inner floor of the sump case 190 for heating washing water, a disposer 180 connected to the motor shaft 231 of the wash motor 230 to rotate integrally with the motor shaft 231 and pulverize food residue, a pump lower 170 mounted to the upper surface of the sump case 190 and including a soil chamber for collecting food residue, a guide passage 140 mounted between the sump cover 130 and the pump lower 170, a wash pump 290 formed between the sump lower 170 and the guide passage 140 for pumping washing water, and a screen filter 179 installed between the pump lower 170 and the disposer 180 for preventing food residue pulverized by the disposer 180 from entering the wash pump 290.

In further detail, the screen filter 179, being a filter with a plurality of small holes formed therein for filtering food residue, is attached to the bottom of the sump lower 170. The wash pump 290 is mounted in the central portion of the pump lower 170, and includes an impeller 150 that is connected to and rotates integrally with the motor shaft 231 and a pump case 171 in which rising washing water swirls by means of the impeller 150. Additionally, a passage is formed at the upper surface of the guide passage 140 for guiding washing water pumped by the wash pump 290 to the fluid passage guide or lower nozzle. The passage will now be described with reference to the diagrams.

In addition, the sump assembly 100 is installed at a side of the sump case 190, and includes a vario valve 210 that intermittently allocates washing water pumped by the wash pump 290 to the upper and lower nozzles, and a turbidity sensor 220 installed proximally to the vario valve 210 for sensing the turbidity of washing water collecting in the sump assembly 100 during a wash cycle. Furthermore, a pump gasket 160 is inserted in a recess formed at the upper portion of the pump lower 170, in order to prevent washing water from leaking from the perimeters of the wash pump 290 and the vario valve 210.

The operation of the sump assembly 100 with the above-described structure will now be set forth.

First, when a wash cycle begins, washing water flows into the sump case 190 from a water supply device, and the wash motor 230 operates to rotate the impeller 150. When the impeller 150 rotates, washing water enters the pump case 171, and the washing water that enters the pump case 171 flows toward the vario valve 210. The washing water that moves to the vario valve 210 flows along the passage on the upper surface of the guide passage 140 to the fluid passage guide 14 or the lower nozzle holder 110. The washing water that moves to the fluid passage guide 14 or the lower nozzle holder 110 is sprayed into the tub by the upper nozzle 15 and the top nozzle 17 or the lower nozzle 16. The food residue on dishes is washed and removed by the sprayed washing water. The washing water sprayed inside the tub falls to the bottom of the tub 11. The washing water that falls down returns to be stored inside of the sump case 190.

A portion of the washing water moving from the wash pump 290 to the vario valve 210 is allotted toward the turbidity sensor 220. The washing water that passes the turbidity sensor 220 to be measured for turbidity then moves to the drain pump 250, and the washing water that moves to the drain pump 250 is dispelled to the outside of the dishwasher by means of the drain motor 240.

Figure 5:
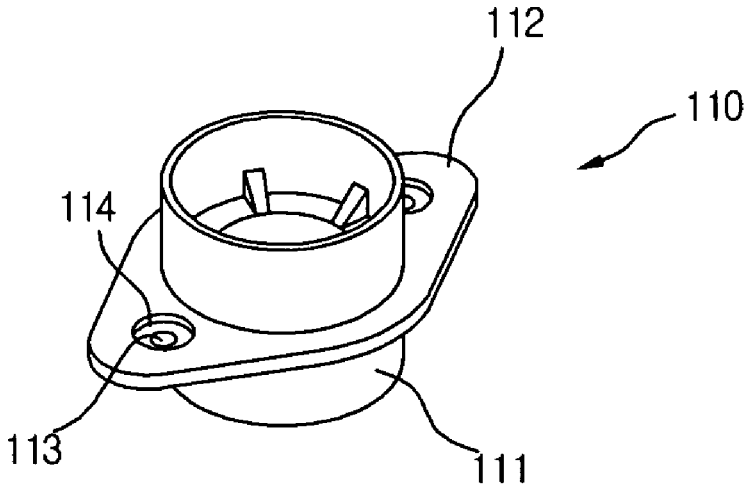
FIG. 5 is a perspective view of a lower nozzle holder depicted in FIG. 2.

FIG. 5 is a perspective view of a lower nozzle holder that is installed at the central top portion of the sump, according to the present invention.

Referring to FIG. 5, the lower nozzle holder 110 has a cylindrical holder body 111 formed with a predetermined diameter and height, and a seating plate 112 formed to extend a predetermined distance radially outward from the outer surface of the holder body 111 for mounting to the upper surface of the sump cover 300.

In further detail, the seating plate 112 includes a coupling hole 113 on at least one side thereof for passing a fastening member that fastens the lower nozzle holder 110 to the sump cover 300 through the coupling hole 113, and a recessed portion 114 with a predetermined depth and diameter formed around the periphery of the coupling hole 113. Accordingly, when the fastening member is fastened, the head of the fastening member does not protrude above the seating plate 112.

Additionally, the holder body 111 extends downward from the seating plate 112 to contact the central portion of the sump cover 130. In other words, the washing water discharge hole (135*a* in FIG. 7) formed in the central portion of the sump cover 130 is directly connected to the holder body 111, so that washing water does not leak out and flows directly to the lower nozzle.

Figure 6:
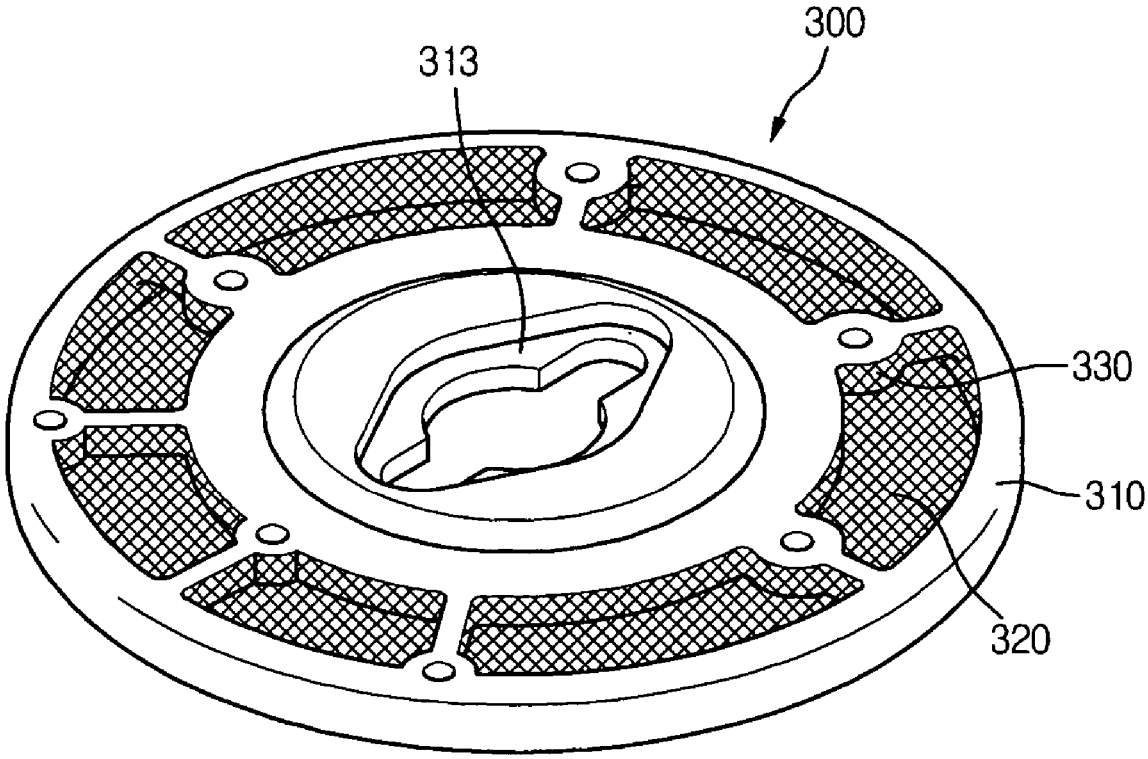
FIG. 6 is a perspective view of a self-cleaning filter assembly depicted in FIG. 2.

FIG. 6 is a perspective view of a self-cleaning filter according to the present invention.

Referring to FIG. 6, a self-cleaning filter assembly 300 according to the present invention includes an upper cover 310 forming the outer shape thereof, a lower cover 330 installed at the bottom of the upper cover 310 and thermal-bonded to the upper cover 310, and a mesh filter 320 interposed between the upper and lower covers 310 and 330 and having a plurality of small holes formed therein.

In more detail, the mesh filter 320 retains a crease-free disposition due to it being pressed between the upper and lower covers 310 and 330. At the approximate central portion of the upper cover 310 is a recessed lower nozzle holder seating portion 313 for mounting the lower nozzle holder 110. The nozzle holder seating portion 313 is formed with an outer shape identical to that of the seating plate 312. Therefore, the lower nozzle holder can be securely located on the self-cleaning filter assembly while being snugly guided.

A detailed description of the self-cleaning filter assembly 300 will now be set forth, with reference to the diagrams.

Figure 7:
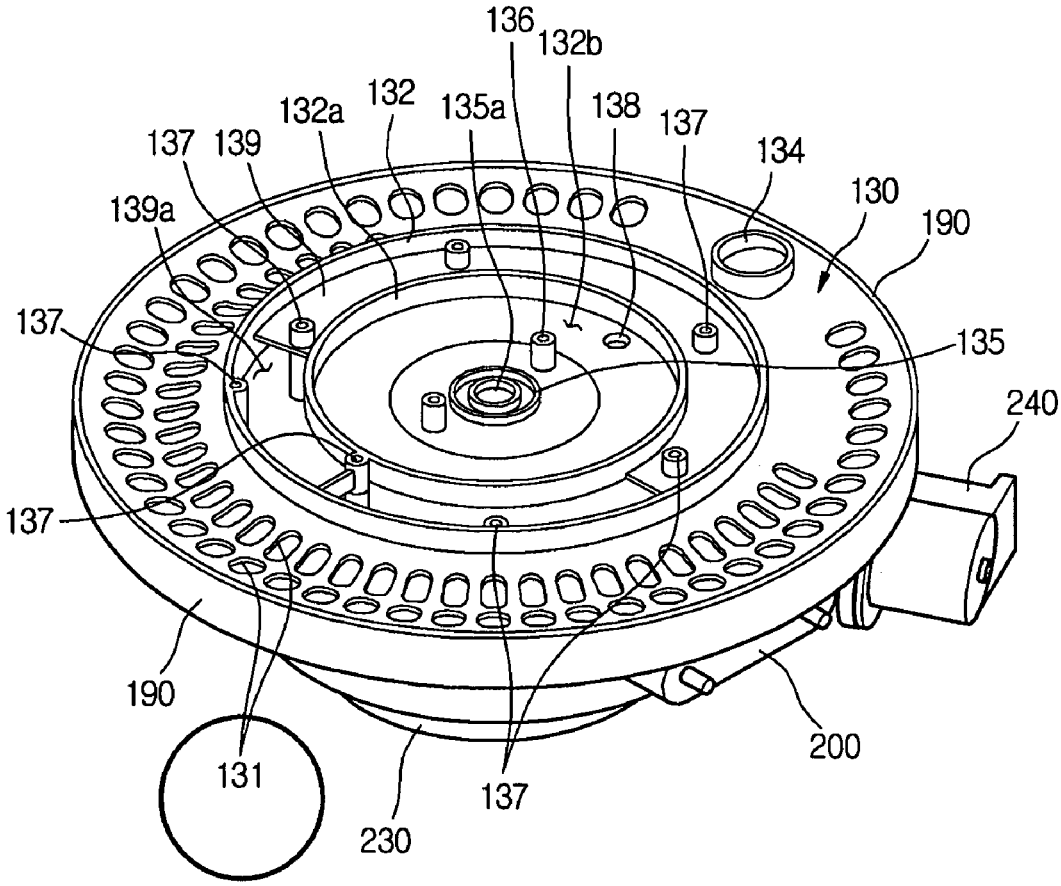
FIG. 7 is a perspective view of a sump assembly depicted in FIG. 1 with the self-cleaning filter removed.

FIG. 7 is a perspective view of a sump with the self-cleaning filter removed, according to an embodiment of the present invention.

Referring to FIG. 7, the self-cleaning filter assembly 300 according to the present invention is mounted to the top portion of the sump cover 130.

Specifically, the sump cover 130 is mounted to the upper portion of the sump case 190, and has a plurality of return holes 131 of a predetermined size formed at the outer periphery thereof for returning the washing water to the sump case 190.

In further detail, the sump cover 130 includes a filter supporting sleeve 132 (formed to protrude a predetermined distance upward from along a perimeter that is radially inward to the return holes 131) for mounting the self-cleaning filter on, and a leakage collecting sleeve 132*a* spaced a predetermined distance radially inward from the filter supporting sleeve 132 and forming a perimeter protruding a predetermined distance upward. Leaked washing water is stored within the wall of the leakage collecting sleeve 132*a* that forms a leakage collecting chamber 132*b*.

Because the filter supporting sleeve 132 is formed at a predetermined height, the mesh filter 320 of the self-cleaning filter assembly 300 is spaced a predetermined height from the sump cover 130. Resultantly, the mesh filter 320 is not immersed in washing water that collects in the tub. Thus, the washing water sprayed downward from the lower nozzle 16 attached to the top of the self-cleaning filter assembly 300 is directly sprayed onto the mesh filter 320 to effectively remove food residue attached to the mesh filter 320.

As described above, since the washing water sprayed downward from the lower nozzle 16 can effectively reach the mesh filter 320, the foreign objects collected at a space below the mesh filter 320 can effectively maintain their suspension states. Furthermore, the foreign objects clogging the mesh filter 320 can be effectively removed by the spraying pressure of the washing water. This can be realized by assembling the self-cleaning filter 300 on the filter supporting sleeve 132 and allowing the filter supporting sleeve 132 to be elevated by a predetermined height above the sump cover 130.

When the filter supporting sleeve 132 is elevated by a predetermined height from the sump cover, the internal space thereof increases and thus the foreign object collecting space also increases.

Also, the sump cover 130 includes a lower nozzle holder support rib 135 coupled to the holder body 111 at the central portion of the lower nozzle holder 110, and a washing water discharge hole 135*a* formed with a predetermined diameter within the lower nozzle support rib 135. Inside the leakage collecting chamber 132, at least one lower nozzle holder fixing boss 136 for coupling the lower nozzle holder 110 is provided. A drain hole 138 is further provided near the periphery of the leakage collecting chamber 132*b* for allowing washing water collected in the leakage collecting chamber 132*b* to fall into the sump case 190.

Also, a washing water reverse flow hole 139*a* (for reversing the flow of washing water pumped by the drain pump 250 through the self-cleaning filter assembly 300 into the tub) forms one portion between the filter supporting sleeve 132 and the leakage collecting sleeve 132*a*, and an foreign object collecting member 139 (for collecting a portion of the washing water that passes through the washing water reverse flow hole 139*a*) forms the other portion between the filter supporting sleeve 132 and the leakage collecting sleeve 132*a*. Also formed is at least one self-cleaning filter fixing boss 137 for fixing the inner surface of the filter supporting sleeve 132 and the outer surface of the leakage collecting sleeve 132*a* to the self-cleaning filter assembly 300 to protrude a predetermined height from the foreign object collecting member 139. At one end of the periphery of the sump cover 130 is a cylindrically-formed fluid passage guide connecting portion 134 for connecting to the lower portion of the fluid passage guide 14.

In the above-structured sump cover 130, the washing water falling into the sump case 190 enters the inside of the sump case 190 through return holes 131. The washing water flowing from the drain pump 250 reverse-flows through the washing water reverse-flow hole 139*a* to the floor of the sump case 190, and then re-enters the sump case 190 through the return holes 131. The washing water pumped by the wash pump 290 flows to the lower nozzle 16 or the fluid passage guide 14 through the washing water discharge hole 135*a* or the fluid passage guide connecting portion 134.

Additionally, during the flowing of washing water to the lower nozzle 16, washing water that leaks through the gap between the lower nozzle holder support rib 135 and the holder body 111 of the lower nozzle holder 110 is collected by the leakage collecting chamber 132*b*. The collected washing water enters the sump case 190 through the drain hole 138.

Furthermore, a portion of the reverse-flowing washing water flowing through the washing water reverse-flow hole 139*a* collects on the foreign object collecting member 139, and moves through the washing water reverse-flow hole 139*a* to the drain pump 250 when the draining process is begun.

Figure 8:
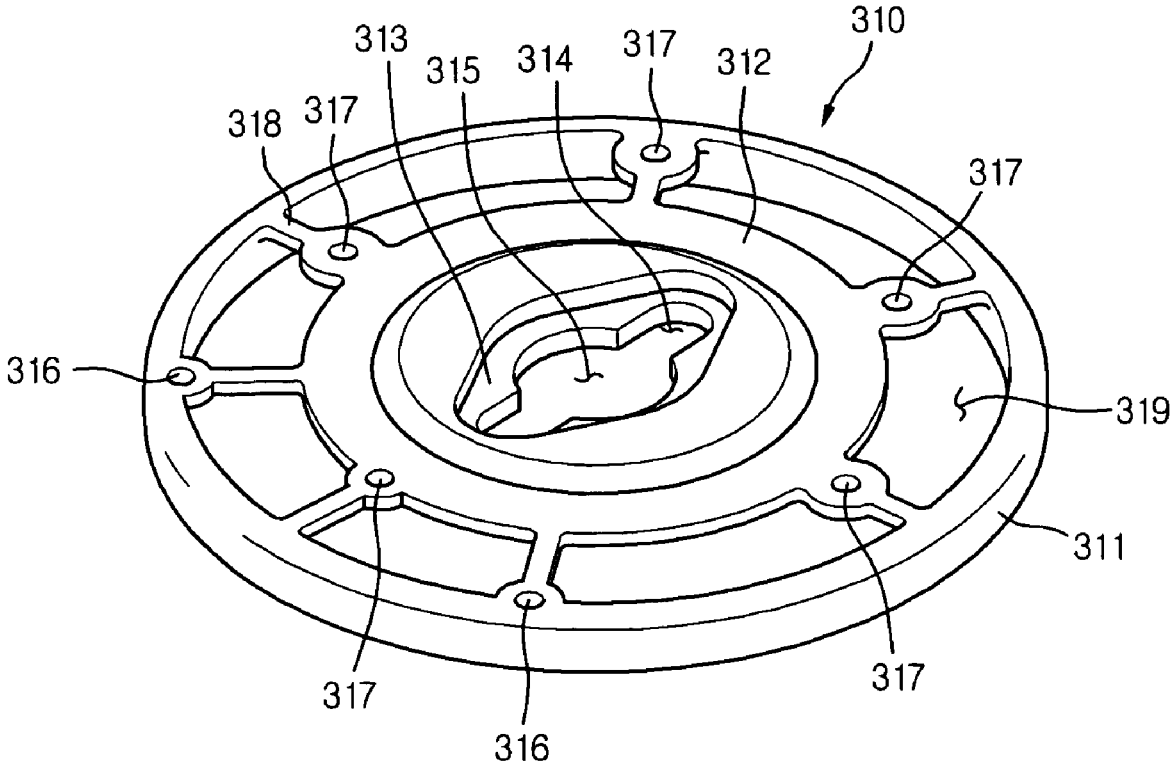
FIG. 8 is a perspective view of an upper cover depicted in FIG. 6.
Figure 9:
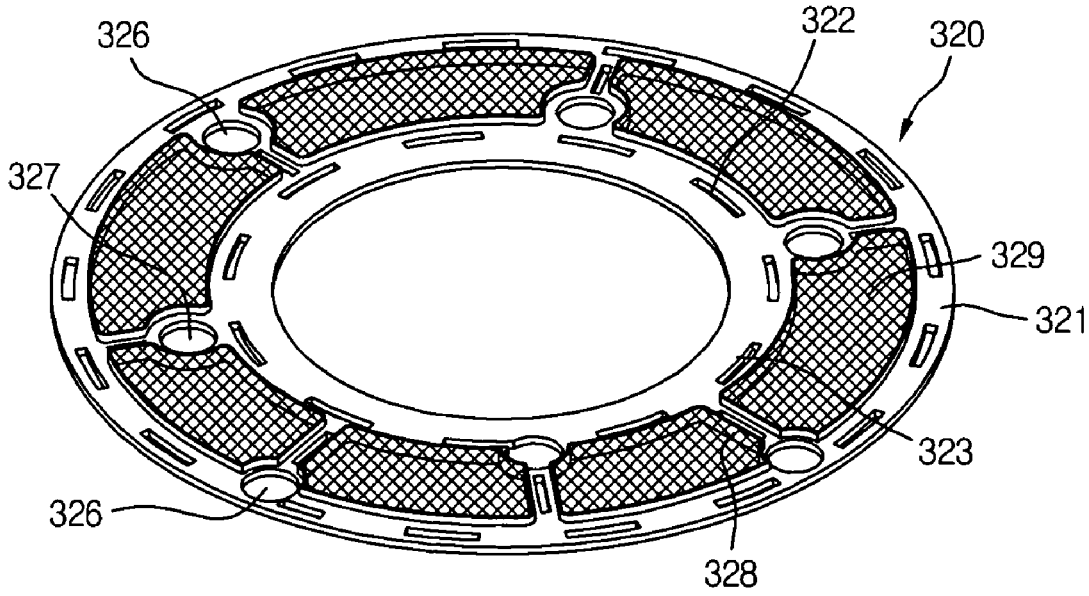
FIG. 9 is a perspective view of a mesh filter depicted in FIG. 6.
Figure 10:
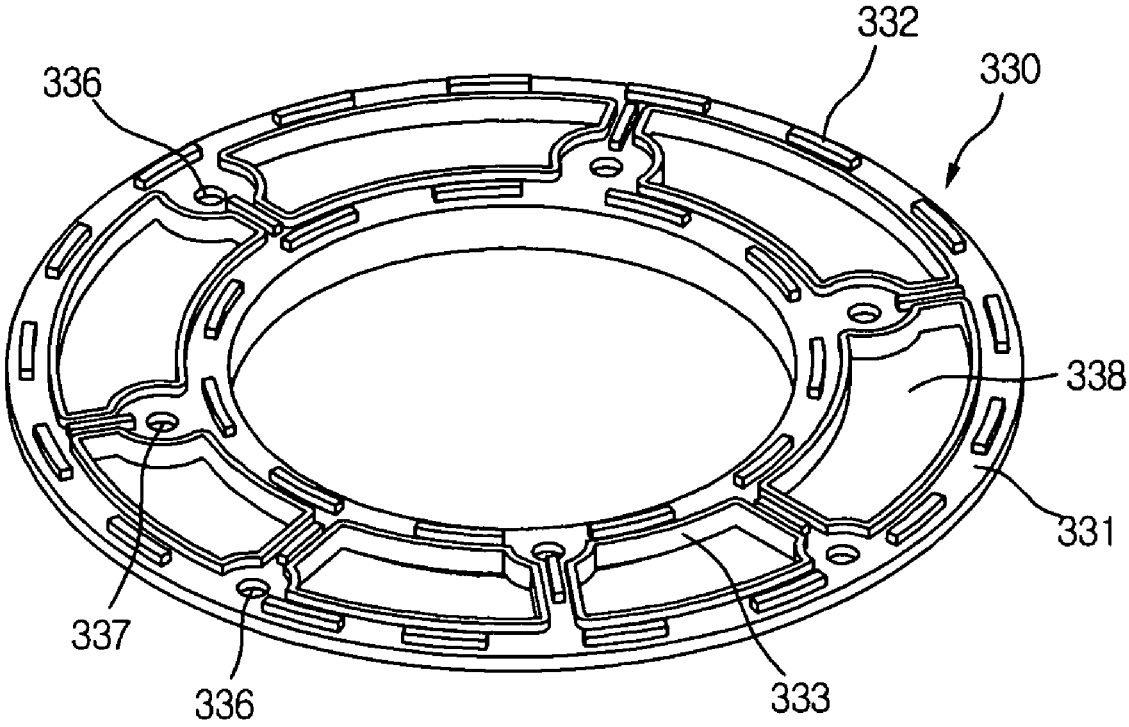
FIG. 10 is a perspective view of a lower cover depicted in FIG. 6.

FIGS. 8 through 10 are perspective views of components of the self-cleaning filter according to the present invention. FIG. 8 is a perspective view of an upper cover used in the self-cleaning filter according to the present invention, FIG. 9 is a perspective view of a mesh filter used in the self-cleaning filter according to the present invention, and FIG. 10 is a perspective view of a lower cover used in the self-cleaning filter according to the present invention.

Referring to FIGS. 8 through 10, the self-cleaning filter assembly 300 according to the present invention, as described above, includes an upper cover 310 forming the upper outer shape thereof, a mesh filter 320 disposed at the bottom surface of the upper cover 310 for filtering foreign object, and a lower cover 330 disposed at the bottom surface of the mesh filter 320 for maintaining the mesh filter 320 in a crease-free state. The upper and lower covers 310 and 330 are integrally assembled using thermal-bonding or vibration-bonding techniques.

In more detail, the upper cover 310 includes a frame 311 forming its outer shape, a leakage collecting chamber cover 312 formed within the frame 311 for covering the upper surface of the leakage collecting chamber 132*b* of the sump cover 130, a lower nozzle holder seating portion 313 formed recessively in the central portion of the leakage collecting chamber cover 312 for receiving the seating plate 112 of the lower nozzle holder 110, and a holder body through-hole 315 and a recessed portion insertion hole 314 formed through the inner surface of the lower nozzle holder seating portion 313 for inserting the holder body 111 and the recessed portion 114 of the lower nozzle holder 110.

Further provided are a frame bridge 318 connecting the frame 311 and the leakage collecting chamber cover 312, a sump case fixing hole 316 formed in the frame bridge 318 for inserting a fixing member that couples the sump cover 130 with the sump case 190, and a sump cover fixing hole 317 for inserting a fixing member that couples the self-cleaning filter assembly 300 to the sump cover 130. Specifically, a mesh hole 319 formed between the frame 311 and the leakage collecting chamber cover 312 is partitioned by the frame bridge 318 into a predetermined size. Also, the mesh (328 in FIG. 9) of the mesh filter 320 is disposed within the mesh hole 319.

The frame 311 of the upper cover 310 forms ribs extending a predetermined distance downward, and the mounting of the self-cleaning filter assembly 300 on the filter supporting sleeve 132 of the sump cover 130 to be spaced a predetermined height above the upper surface of the sump cover 130 is the same as described above. Referring to FIG. 2, it can be noted that the rib 340 contacts the outer portion of the filter supporting sleeve 132 and the mounting of the self-cleaning filter assembly 300 can be effectively guided by the rib 340.

Also, the mesh filter 320 is installed at the bottom of the upper cover 310, the outer frame is attached to the lower end of the frame 311 of the upper cover 310, the inner frame 323 is attached to the bottom of the outer periphery of the leakage collecting cover, a sump case coupling hole 326 and a sump cover coupling hole 327 communicate with the frame bridge 328 (attached to the bottom of the frame bridge 318) and the sump case coupling hole 316, and a mesh 329 installed between the inner and outer frames 323 and 321. Here, the mesh 329 is partitioned by the frame bridge 328, and is flattened during the thermal bonding process of the frame bridge 328 between the frame bridge of the upper cover 310 with the frame bridge 338 of the lower cover 330.

Also, formed in the outer frame 321, the inner frame 323, and the frame bridge 328 is at least one thermal bonding rib through-hole 322 for inserting the thermal bonding rib (332 in FIG. 10) formed on the lower cover 330.

Furthermore, the lower frame 330 includes an outer frame 331 attached to the bottom of the outer frame 321 of the mesh filter 320, an inner frame 333 attached to the bottom of the inner frame 323, a frame bridge 338 attached to the bottom of the frame bridge 328, and a sump case coupling hole 336 and a sump cover coupling hole 337 communicating with the sump case coupling hole 326 and the sump cover coupling hole 327. Also, at least one thermal bonding rib 332 is formed on the inner frame 333, the outer frame 331, and the frame bridge 338.

In further detail, the thermal bonding rib 332 passes through the thermal bonding rib through-hole 332 and is thermal-bonded or ultrasound-bonded to the bottom of the upper cover 310. Because the upper cover 310 and the lower cover 330 are firmly thermal-bonded or vibration-bonded with each other, the mesh 329 is flattened and does not crease when the temperature of the self-cleaning filter 300 cools after the thermal-bonding process.

That is, the thermal bonding rib 332 is thermal-bonded to the upper cover 310 so that the self-cleaning filter 300 is assembled with the lower cover 330 pressed firmly against the upper cover 310. Here, the mesh filter 320 is fixed according to the adhering force provided by the thermal bonding rib 332 inserted through the thermal bonding rib through-hole 332. Accordingly, because the mesh filter 320 is not directly thermal-bonded to the upper and lower covers 310 and 330, there is virtually no deformation of the mesh filter 320 when temperature drops after the self-cleaning filter 300 is combined.

In the above-described embodiment, although the filter supporting sleeve is cylindrically elevated by a predetermined height, the present invention is not limited to this. However, in order to allow the internal space of the filter supporting sleeve to be separated from the outside, a section of the supporting sleeve must be formed in a closed-curve shape.

According to the present invention, the self-cleaning filter assembly for collecting foreign objects in the sump assembly is elevated by predetermined height from the floor of the tub by modifying the structure of the sump assembly.

In addition, since the washing water sprayed downward from the lower nozzle can effectively reach the self-cleaning filter assembly, the foreign object collecting efficiency of the self-cleaning filter assembly can be improved. Furthermore, since the internal space of the filter supporting sleeve, the collectable volume of the self-cleaning filter can increase.

In addition, the purifying capability of the self-cleaning filter assembly increases. Since an amount of the foreign objects clogging in the sump assembly, the user's displeasure can be reduced.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A sump assembly of a dishwasher, comprising:

a sump case installed at a bottom of tub of the dishwasher, for reserving washing water;

a sump cover which seats on the sump case to cover an opening defined on an upper end of the sump case, the sump cover allowing washing water to pass through;

a filter supporting sleeve extended a predetermined height from a top surface of the sump cover;

a self-cleaning filter assembly installed on the filter supporting sleeve, and including an upper cover, a lower cover disposed under the upper cover, and a mesh filter disposed between the upper and lower covers to filter foreign objects entrained in the washing water which flows backward from the sump case; and a fluid passage guide for discharging the washing water stored in the sump case in a predetermined direction, the fluid passage guide having a washing pump therein, wherein the upper surface of the self-cleaning filter assembly is configured to be higher than the upper surface of the sump cover.

2. The sump assembly according to claim 1, wherein a section of the filter supporting sleeve is formed in a closed-curve shape.

3. The sump assembly according to claim 1, further comprising a rib extending downward from a frame of the self-cleaning filter assembly and aligned with the filter supporting sleeve.

4. The sump assembly according to claim 1, wherein the sump cover includes a foreign object collecting layer formed in the filter supporting sleeve and having a predetermined area.

5. The sump assembly according to claim 1, wherein the sump cover includes a washing water reverse flow hole so that the washing water flows backward from the sump case, and the washing water reverse flow hole is located in the inner portion of the filter supporting sleeve.

6. A sump assembly of a dishwasher, comprising:

a sump case for reserving washing water;

a fluid passage guide having a washing pump therein to discharge washing water in a plurality of directions;

a sump cover provided on an upper portion of the fluid passage guide to cover opening of the fluid passage guide and exposed to an inside of a tub to receive the washing water;

a filter supporting sleeve protruded in an upward direction from an upper surface of the sump cover;

a self-cleaning filter mounted on the filter supporting sleeve such that the self-cleaning filter is located a predetermined height apart form the sump cover, and including an upper cover and a lower cover disposed under the upper cover; and a mesh filter disposed between the upper and lower cover to filter foreign objects entrained in the washing water flowing backward from the sump cover toward the tub.

7. The sump assembly according to claim 6, wherein the filter supporting sleeve has a section formed in a circular shape.

8. The sump assembly according to claim 6, wherein the foreign objects are collected in an internal space of the filter supporting sleeve.

9. The sump assembly according to claim 8, wherein the filter supporting sleeve has a section that is close-curved.

10. The sump assembly according to claim 6, further comprising a rib extending downward from the self-cleaning filter and aligned with a side portion of the filter supporting sleeve.

11. The sump assembly according to claim 10, wherein the rib extends downward from a frame of the self-cleaning filter.

12. The sump assembly according to claim 6, wherein the sump cover includes a plurality of return holes formed at an outer periphery thereof so that the washing water falling down to the bottom of the tub returns to the inside of the sump case.

13. The sump assembly according to claim 6, wherein the water leaked from a nozzle holder is accumulated in an internal space of the filter supporting sleeve.

14. A sump assembly of a dishwasher, comprising:

a sump case for reserving washing water;

a fluid passage guide having a washing pump therein to discharge washing water in a plurality of directions;

a sump cover provided on an upper portion of the fluid passage guide and exposed to an inside of the tub to receive and conduct the washing water into the sump case;

a lower nozzle for spraying downward the washing water directed through the fluid passage guide;

a filter supporting sleeve integrally formed with the sump cover and protruded above the sump cover;

a self-cleaning filter which seats on the filter supporting sleeve such that the self-cleaning filter is maintained higher than the sump cover to prevent submergence by the washing water stored in the sump case, and including an upper cover and a lower cover disposed under the upper cover; and a mesh filter provided between the upper and lower cover to filter foreign objects entrained in the washing water flowing backward from the sump cover toward the tub.

15. The sump assembly according to claim 14, further comprising a rib extending downward from the self-cleaning filter assembly and aligned with a side portion of the filter supporting sleeve.

16. The sump assembly according to claim 15, wherein the rib extends downward from a frame of the self-cleaning filter assembly.

17. The sump assembly according to claim 14, wherein the foreign objects is collected in an internal space of the self-cleaning filter assembly.

18. The sump assembly according to claim 14, wherein the washing water sprayed from the lower nozzle reaches the self-cleaning filter assembly.

19. The sump assembly according to claim 14, wherein the self-cleaning filter defines a top surface of the sump assembly by seating on the filter supporting sleeve.

* * * * *